US006655877B2

(12) United States Patent
Calhoun

(10) Patent No.: US 6,655,877 B2
(45) Date of Patent: Dec. 2, 2003

(54) YIELDING COLUMN

(76) Inventor: W. David Calhoun, 504 Ash St., Bristol, TN (US) 37620

( * ) Notice: Subject to any disclaimer, the term of this patent is extended or adjusted under 35 U.S.C. 154(b) by 0 days.

(21) Appl. No.: 10/122,371

(22) Filed: Apr. 16, 2002

(65) Prior Publication Data

US 2003/0194280 A1 Oct. 16, 2003

(51) Int. Cl.[7] ..... E21D 15/02; E04G 25/02

(52) U.S. Cl. ..... 405/288; 299/11; 299/12; 248/542; 248/548

(58) Field of Search ..... 405/288; 299/11, 299/12; 248/542, 548

(56) References Cited

U.S. PATENT DOCUMENTS

| | | | | | |
|---|---|---|---|---|---|
| 1,677,796 | A | * | 7/1928 | Parks | 248/548 |
| 2,029,789 | A | * | 2/1936 | Parks | 248/548 |
| 2,036,490 | A | * | 4/1936 | Neilson et al. | 405/288 |
| 2,450,374 | A | * | 9/1948 | Gillet | 243/354.1 |
| 2,745,622 | A | | 5/1956 | Zindel | |
| 3,538,785 | A | * | 11/1970 | Grancon | 74/492 |
| 4,006,647 | A | * | 2/1977 | Oonuma et al. | 74/492 |
| 4,052,029 | A | | 10/1977 | Townsend | |
| 4,255,071 | A | | 3/1981 | Koppers et al. | |
| 4,269,384 | A | * | 5/1981 | Saeed et al. | 248/548 |
| 4,281,487 | A | | 8/1981 | Koller | |
| 4,535,531 | A | | 8/1985 | Brown | |
| 4,712,947 | A | | 12/1987 | Thom | |
| 5,012,622 | A | | 5/1991 | Sato et al. | |
| 5,015,125 | A | | 5/1991 | Seegmiller | |
| 5,056,753 | A | * | 10/1991 | Lunau et al. | 74/492 |
| 5,160,111 | A | * | 11/1992 | Hugron | 248/548 |
| 5,205,688 | A | * | 4/1993 | Sundstrom | 411/38 |
| 5,207,750 | A | * | 5/1993 | Rapata | 411/38 |
| 5,228,810 | A | * | 7/1993 | Seegmiller | 405/290 |
| 5,314,161 | A | * | 5/1994 | Domanski et al. | 248/354.1 |
| 5,400,994 | A | | 3/1995 | Shawwaf et al. | |
| 5,538,364 | A | * | 7/1996 | Huntsman | 405/288 |
| 5,564,867 | A | | 10/1996 | Domanski et al. | |
| 5,725,341 | A | * | 3/1998 | Hofmeister | 411/32 |
| 5,813,649 | A | | 9/1998 | Peterson et al. | |
| 6,216,413 | B1 | * | 4/2001 | Lapointe | 52/726.3 |
| 6,293,743 | B1 | * | 9/2001 | Ernst et al. | 411/24 |

* cited by examiner

*Primary Examiner*—J. J. Swann
*Assistant Examiner*—Katherine Mitchell
(74) *Attorney, Agent, or Firm*—Shoemaker and Mattare

(57) ABSTRACT

A yielding column for support mine roofs or the like includes a tube provided with one or more circumferential rows of slots which provide a preferred locus for buckling. A reinforcing sleeve within the tube prevents inward buckling, so that the buckled portions are easily seen.

6 Claims, 4 Drawing Sheets

FIG. 1
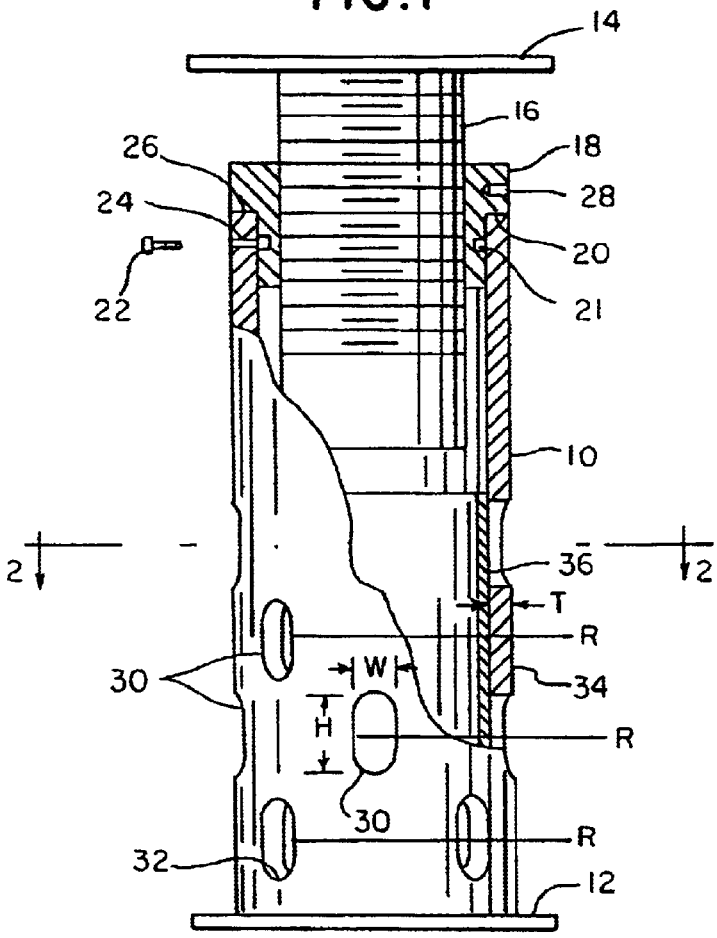
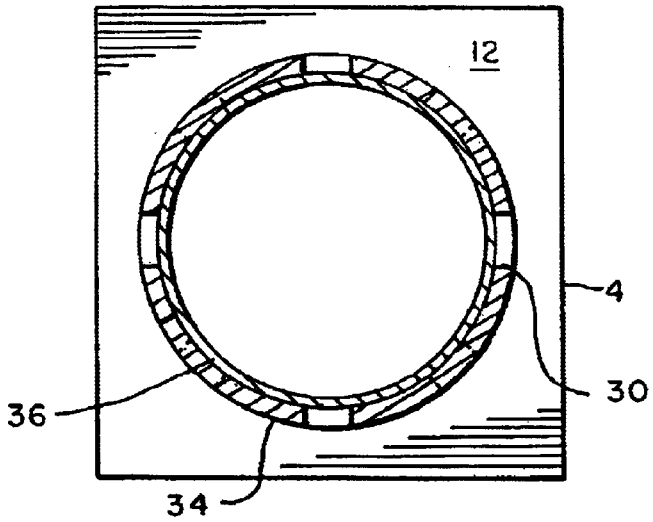
FIG. 2

FIG. 3
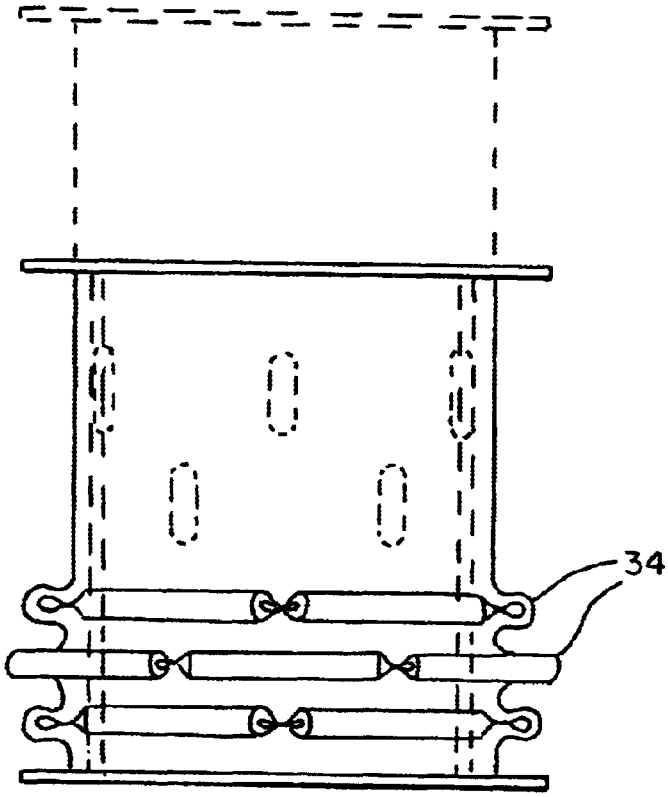
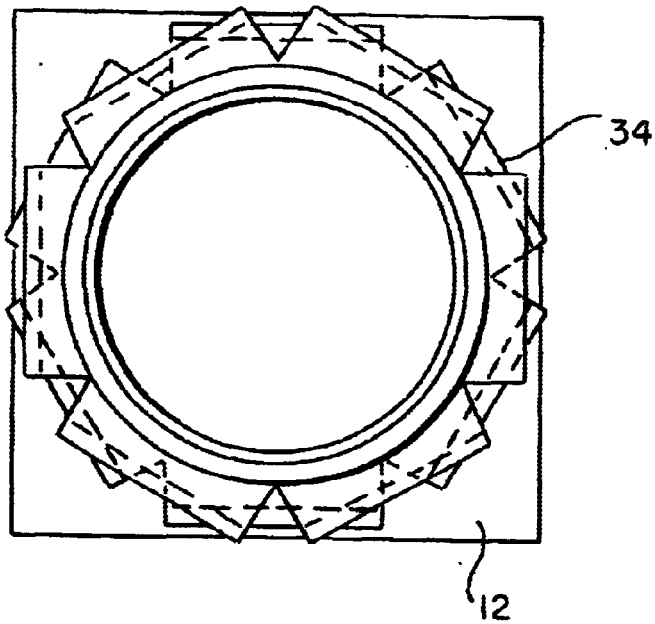
FIG. 4

YIELDING COLUMN

BACKGROUND OF THE INVENTION

This invention relates to a yielding column for use in mines or structures.

Yielding columns are used in mines to provide indications of roof movement possibly leading to roof failure, while supporting the roof. A portion of the column is designed to provide a visible indication of yielding at a load somewhat below the ultimate strength of the column. A good column absorbs a lot of strain before it fails. FIG. 6 shows the characteristics of various roof-supporting arrangements. Wood cribs are excellent in this regard, as they have a long, flat stress-strain curve.

SUMMARY OF THE INVENTION

An object of the invention is provide a yielding column providing an improved visible indication of load indicative of potential roof failure.

Another object is to provide a support having a broad stress-strain curve.

These and other objects are attained by a yielding column as described below.

BRIEF DESCRIPTION OF THE DRAWINGS

In the accompanying drawings,

FIG. 1 is a front elevation of a yielding column embodying the invention, partly broken away to show a cross-section thereof on a vertical bisecting plane;

FIG. 2 is a cross-sectional view thereof, taken on the line 2—2 in FIG. 1;

FIG. 3 is a view like FIG. 1, showing the column in its post-yield configuration;

FIG. 4 is a cross-sectional view thereof, corresponding to FIG. 2;

DESCRIPTION OF THE PREFERRED EMBODIMENT

Figure 5:
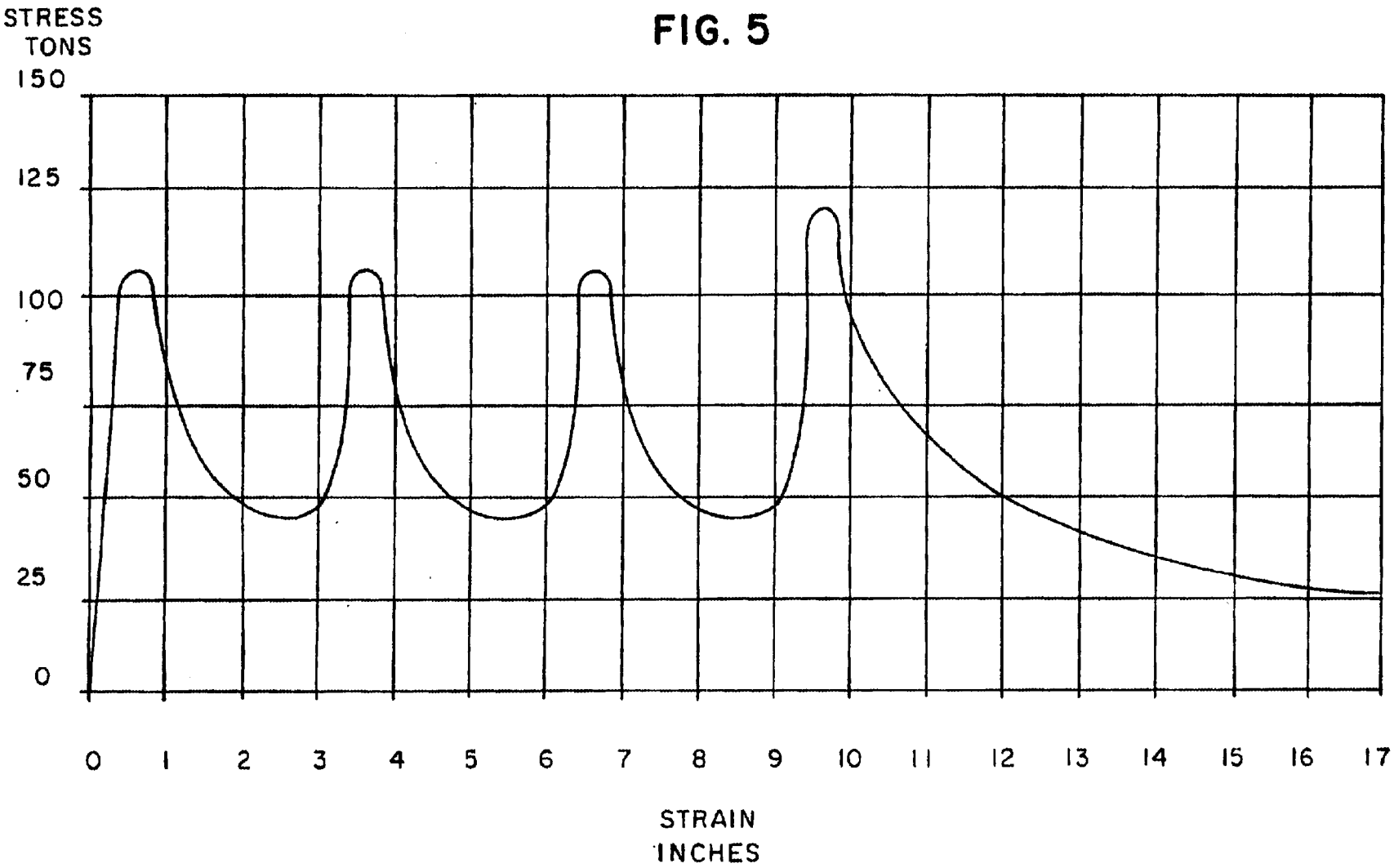
FIG. 5 is a stress-strain diagram for the column under compression.
Figure 6:
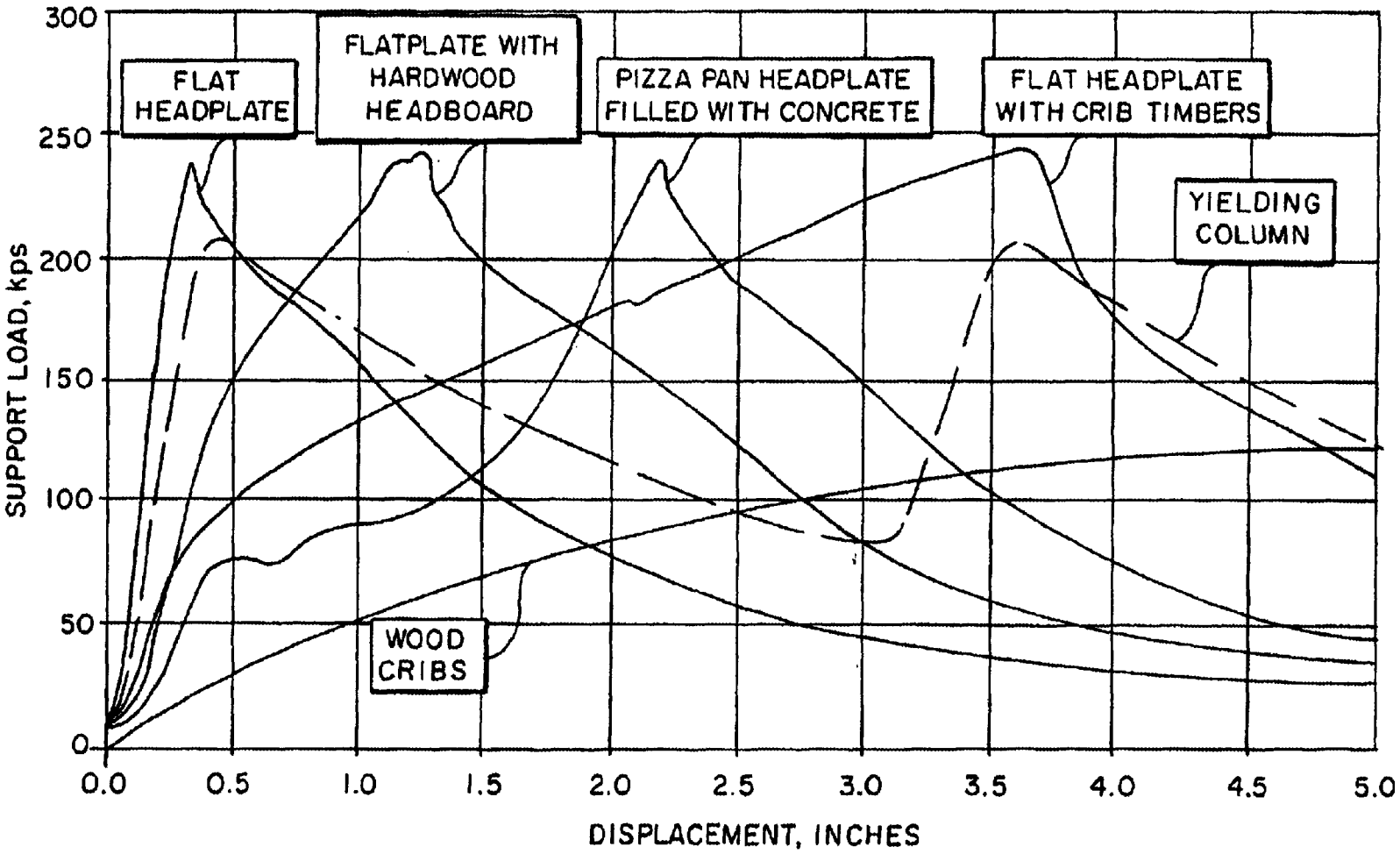
FIG. 6 is a similar stress-strain diagram of various prior art structures, with a portion of the diagram of FIG. 5 superimposed.

A yielding column embodying the invention comprises a steel tube 10 having foot and head plates 12, 14. The head plate 14 is welded to a screw pipe 16. The external threads of the screw pipe engage internal threads on a collar 18. The collar is circumferentially undercut to the inner diameter of the tube at its bottom, leaving an external circumferential shoulder 20 at the top. The undercut portion has a circumferential groove 21 in its outer surface for receiving a set screw 22 which is received in a threaded hole 24 extending through the wall of the tube near its upper end 26. The collar shoulder bears against this upper end. The hole 28 at the collar end is for receiving a wrench (not shown).

A number of slots 30 are formed in the wall of the tube. Preferably, each slot has a fixed width, except at its rounded ends 32, and extends entirely through the tube wall. The slots are preferably arranged in two or more circumferential rows "R", the spacing of slots within each row being uniform and extending around the entire circumference. The row-to-row spacing is preferably uniform as well. Alternating rows are staggered so that the slots are misaligned between adjacent rows, preferably by one-half of the slot-to-slot pitch within a given row.

The height "H" and width "W" of the slots may be varied according to the desired predetermined axial load; the geometry shown in the drawings is merely preferred. The drawings show four slots in each row. Each slot has a width about twice the wall thickness "T", and a height about three times the slot width. The load-supporting pillars 34 remaining between the slots thus have approximately equal height and width, each about three times the wall thickness. The combined load bearing capacity of the pillars is reduced in proportion to the width of the slots.

A reinforcing sleeve 36 fits snugly within the tube 10, to prevent inward buckling and to keep the ends of the tube aligned. It is sufficiently long to span at least the length of all the slots, and short enough not to become a load-bearing member as the column collapses.

Under progressive axial load, the pillars deform elastically at first. When the load exceeds a limit determined by their size, material and geometry, the pillars tend to buckle in a direction perpendicular to the wall thickness. They are prevented from buckling inward by the reinforcing sleeve, and thus fold outward, increasingly until their tops and bottoms meet, as shown in FIGS. 3 and 4. The pillar deformation is substantially plastic, and the results are highly visible. Thus an inspector can spot from a distance a column which is overloaded.

As one can see in FIG. 5, the column strength declines while one row of pillars are buckling. For this reason, the rows collapse one at a time, producing the undulating stress-strain curve shown. The curve can be extended, up to a point, by providing more rows of slots.

The strength of the column is affected by the geometry of the pillars. Taller, or more slender, columns tend to buckle under less load. There is no minimum slot width: the invention works with slots (slits) having little or no width. Any number of slots may be provided, up to a maximum where the pillar width is less than the tube wall thickness and the pillars would tend to buckle sideways. If the pillars are too short, they will yield in pure (plastic) compression, which is hard to see, and they would not in that case absorb as much strain, so I prefer that the pillar height be at least three times the wall thickness. The slots need not have uniform width. "Slots" should be understood to include other aperture shapes, including circular holes. The ends of the slots need not be rounded, as shown, but rounding is preferred to prevent stress concentration at the ends of the slots. Also, while the column need not necessarily be round in cross-section, that is my preference. "Tube" should be understod to include non-circular tubes. Furthermore, it is possible that the invention may be applied to tubes having non-uniform wall thickness.

The metal chosen should have sufficient ductility that the pillars can bend to the degree shown in FIG. 3 without breaking. A preferred material is 1010 carbon steel.

While I have described the utility of the invention as for mine supports, the invention may find use in other applications, such as supporting portions of buildings. I intend not to limit this invention to mine use only.

Since the invention is subject to modifications and variations, it is intended that the foregoing description and the accompanying drawings shall be interpreted as only illustrative of the invention defined by the following claims.

I claim:

1. A yielding mine support column comprising a metal tube having a wall with a wall thickness, a plurality of slots extending through said wall, defining therebetween a plurality of pillars, said slots being arranged in at least one circumferential row extending around said tube, to provide a preferred locus for deformation of the tube under axial load, and a sleeve fitting snugly within the tube, said sleeve spanning at least the length of all the slots, to prevent inward buckling of the pillars and to maintain alignment between the ends of the tube, and being short enough not to become a load-bearing member as the column collapses.

2. The invention of claim 1, wherein the slots are disposed in plural circumferential rows.

3. The invention of claim 2, wherein the slots in adjacent rows are staggered with respect to one another.

4. The invention of claim 3, wherein the slots define a plurality of pillars, and the width and number of the slots is selected so that each pillar has a height equal to at least three times said wall thickness.

5. The invention of claim 4 wherein the pillars have a width greater than said wall thickness.

6. The invention of claim 4, wherein the tube is made of a material which is sufficiently ductile that the material does not fail when the pillars are fully buckled.

* * * * *